US009321294B2

(12) United States Patent
Scheuer

(10) Patent No.: US 9,321,294 B2
(45) Date of Patent: Apr. 26, 2016

(54) SECURITY DOCUMENT AND METHOD FOR PRODUCING A SECURITY DOCUMENT

(71) Applicant: LEONHARD KURZ Stiftung & Co. KG, Fürth (DE)

(72) Inventor: Jürgen Scheuer, Treuchtlingen (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 48 days.

(21) Appl. No.: 14/374,057

(22) PCT Filed: Jan. 21, 2013

(86) PCT No.: PCT/EP2013/051024

§ 371 (c)(1),
(2) Date: Jul. 23, 2014

(87) PCT Pub. No.: WO2013/110565

PCT Pub. Date: Aug. 1, 2013

(65) Prior Publication Data

US 2015/0018206 A1 Jan. 15, 2015

(51) Int. Cl.
*B41M 3/12* (2006.01)
*B41M 3/14* (2006.01)
(Continued)

(52) U.S. Cl.
CPC ..... *B42D 25/24* (2014.10); *B41M 3/12* (2013.01); *B41M 3/142* (2013.01); *B41M 5/267* (2013.01);
(Continued)

(58) Field of Classification Search
CPC ..... B41M 3/12; B41M 3/142; B41M 5/26; B41M 5/267; B41M 5/30; B41M 2205/38; B41M 2205/40; G09F 3/02; G09F 3/0291; G09F 2003/0211; B42D 15/00; B42D 15/0013; B42D 15/10; B42D 15/105; B42D 25/351; B42D 2033/0201; B42D 2033/0255; B42D 2033/04; B42D 2033/18; B42D 2033/40; B42D 2033/0055
USPC ..... 503/200–226; 283/72, 94, 109, 110; 427/152
See application file for complete search history.

(56) References Cited

U.S. PATENT DOCUMENTS 4,579,754 A 4/1986 Maurer et al.
4,765,656 A 8/1988 Becker et al.
(Continued)

FOREIGN PATENT DOCUMENTS

CA 2745913 6/2010
CN 2166496 5/1994
(Continued)

*Primary Examiner* — Bruce H Hess
(74) *Attorney, Agent, or Firm* — Hoffmann & Baron, LLP

(57) ABSTRACT

The invention relates to a security document (30"), to a method for producing a security document (30"), and to a method for producing an individualized security document (30"). The security document (30") has a carrier substrate (1) with a carrier layer (10) and a thermosensitive coating (11) which can be caused to change color by the action of heat, in particular by means of a thermal print head (911). The security document (30") further has a film element (2), which is transparent at least in areas and which has at least one decorative layer (24, 25) with at least one optical security feature (51, 52), and an adhesive layer (3). The adhesive layer (3) is arranged between the film element (2) and the carrier substrate (1). The thermosensitive coating (11) is arranged between the adhesive layer (3) and the carrier layer (10). The film element (2) covers the thermosensitive coating (11) at least in areas when viewed perpendicularly to the plane spanned by the upper side of the carrier substrate.

24 Claims, 5 Drawing Sheets

(51) Int. Cl.

| | |
|---|---|
| ***B41M 5/26*** | (2006.01) |
| ***B42D 25/351*** | (2014.01) |
| ***G09F 3/02*** | (2006.01) |
| ***B42D 25/24*** | (2014.01) |
| ***B42D 25/355*** | (2014.01) |
| ***B42D 25/25*** | (2014.01) |
| ***B41M 5/42*** | (2006.01) |
| ***G09F 3/00*** | (2006.01) |
| *B42D 25/26* | (2014.01) |

(52) U.S. Cl.

CPC ..... *B41M 5/42* (2013.01); *B42D 25/25* (2014.10); *B42D 25/351* (2014.10); *B42D 25/355* (2014.10); *G09F 3/0291* (2013.01); *B42D 25/26* (2014.10); *G09F 2003/0201* (2013.01); *G09F 2003/023* (2013.01); *G09F 2003/0207* (2013.01); *G09F 2003/0226* (2013.01); *G09F 2003/0255* (2013.01)

(56) References Cited

U.S. PATENT DOCUMENTS

| | | | |
|---|---|---|---|
| 5,104,471 | A | 4/1992 | Antes et al. |
| 5,527,758 | A | 6/1996 | Uyttendaele et al. |
| 5,714,213 | A | 2/1998 | Antes et al. |
| 5,863,859 | A | 1/1999 | Uyttendaele et al. |
| 6,338,436 | B1 | 1/2002 | Iguchi et al. |
| 6,501,495 | B1 | 12/2002 | Ichikawa et al. |
| 6,602,578 | B1 | 8/2003 | Tompkin et al. |
| 2003/0136847 | A1 | 7/2003 | Braun |
| 2003/0197775 | A1 | 10/2003 | Sato et al. |
| 2005/0142342 | A1 | 6/2005 | Lutz et al. |
| 2006/0127649 | A1 | 6/2006 | Keller et al. |
| 2009/0061159 | A1 | 3/2009 | Staub et al. |
| 2009/0181261 | A1 | 7/2009 | Lindemann et al. |
| 2010/0151207 | A1 | 6/2010 | Hansen et al. |
| 2010/0315417 | A1 | 12/2010 | Cho et al. |
| 2011/0200765 | A1 | 8/2011 | Uyttendaele et al. |

FOREIGN PATENT DOCUMENTS

| | | |
|---|---|---|
| DE | 2907004 | 8/1980 |
| DE | 3151407 | 10/1983 |
| DE | 3634865 | 6/1987 |
| DE | 4339216 | 4/1994 |
| DE | 69313889 | 9/1997 |
| DE | 19915943 | 10/2000 |
| DE | 102005017169 | 10/2006 |
| DE | 10243653 | 11/2006 |
| DE | 60306446 | 6/2007 |
| DE | 60029673 | 10/2007 |
| DE | 102006022798 | 11/2007 |
| DE | 102007044482 | 3/2009 |
| DE | 102008062149 | 4/2010 |
| DE | 102005017170 | 7/2010 |
| DE | 102008005019 | 8/2010 |
| EP | 0216947 | 4/1987 |
| EP | 0401466 | 12/1990 |
| EP | 0537439 | 4/1993 |
| EP | 2082894 | 7/2009 |
| WO | WO0162509 | 8/2001 |
| WO | WO03095745 | 11/2003 |
| WO | WO2009127325 | 10/2009 |

SECURITY DOCUMENT AND METHOD FOR PRODUCING A SECURITY DOCUMENT

This application claims priority based on an International Application filed under the Patent Cooperation Treaty, PCT/EP2013/051024, filed on Jan. 21, 2013, and German Application No. DE 102012001121.0, filed on Jan. 23, 2012.

BACKGROUND OF THE INVENTION

The invention relates to a security document, to a method for producing a security document, and to a method for producing an individualized security document.

Travel tickets and travel information are increasingly being provided by ticket vending machines. In order to increase the protection against forgery of travel tickets, the ticket vending machine is often stocked with a security paper which is provided with an individualized imprint, which for example indicates the destination and the period of validity, by the ticket vending machine when the travel ticket is issued. Protection against forgery is particularly important in the case of weekly, monthly or annual tickets which are valid for longer and of higher value or in the case of international travel tickets for cross-border traffic.

SUMMARY OF THE INVENTION

The object of the invention now is to increase the protection against forgery of individualizable security documents, in particular of tickets and travel tickets.

This object is achieved by a security document which is provided with a carrier substrate which has a carrier layer and a thermosensitive coating which can be caused to change color by the action of heat, in particular by means of a thermal print head, is provided with a film element which is transparent at least in areas and which has at least one decorative layer with at least one optical security feature, and is provided with an adhesive layer, wherein the adhesive layer is arranged between the film element and the carrier substrate, the thermosensitive coating is arranged between the adhesive layer and the carrier layer, and the film element covers the thermosensitive coating at least in areas when viewed perpendicularly to the plane spanned by the upper side of the carrier substrate.

This object is further achieved by a method for producing a security document in which first a carrier substrate with a carrier layer and a thermosensitive coating which is caused to change color by the action of heat, in particular by means of a thermal print head, is provided and then a film element, which is transparent at least in areas and which has at least one decorative layer with at least one optical security feature, is applied to the carrier substrate in such a way that the thermosensitive coating is arranged between the film element and the carrier layer and the film element covers the thermosensitive coating at least in areas when viewed perpendicularly to the plane spanned by the upper side of the carrier substrate.

This object is further achieved by a method for producing an individualized security document in which a security paper, which has a carrier substrate that has a carrier layer and a thermosensitive coating that is caused to change color by the action of heat, and which has a film element which is transparent at least in areas, wherein the film element covers the thermosensitive coating at least in areas when viewed perpendicularly to the plane spanned by the upper side of the carrier substrate, is fed to a printer and the printer inscribes a first item of information by means of a thermal print head by activating the color change of the thermosensitive coating in areas in such a way that at least part of the first item of information is covered by the film element when viewed perpendicularly to the plane spanned by the upper side of the carrier substrate.

By a security document is meant here both a separate security document, such as for example a travel ticket or a ticket, and a security paper, which, for example by cutting, can be separated into several separate security documents.

It has been shown that the protection against forgery of security documents can be increased significantly by a procedure of this type. The thermosensitive coating is arranged between the film element and the carrier layer, with the result that the thermosensitive layer and the data inscribed in this area are no longer freely accessible and are protected by the film element from tampering attempts. As it is no longer possible to access the thermosensitive layer directly in this area and furthermore the thermosensitive layer is also connected to the film element via an adhesive layer, mechanical tampering attempts lead to damage to the film element and thus to the security features provided on it, with the result that tampering attempts are easily recognizable. Furthermore, tampering attempts are also made more difficult by the special properties of the thermosensitive coating, as attempts to remove it based on heating the value document for example with a hairdryer lead to the entire surface changing color, with the result that such forgery attempts are also immediately recognizable.

Removal attempts by means of solvents to erase the individualized imprint are made more difficult because at the same time the film element is removed by the solvents in a destructive manner on the one hand and simultaneously the thermosensitivity function of the thermosensitive coating is destroyed, which in particular prevents re-inscription by means of a thermal print head. Re-inscription of the security document in particular by means of inkjet technology or dot matrix technology is thereby made more difficult because these inscriptions are then recognizably arranged above the film element. Furthermore, it is particularly to be emphasized that the previously described advantages are achieved in a particularly cost-effective way by means of the invention. The security documents which have not yet been individualized can be produced cost-effectively on a large scale and it is only necessary to use a cost-effective printer without additional handling steps (for example the additional lamination of a film onto an individualized imprint is dispensed with) to individualize the security documents. It is therefore possible, with a very small technical outlay, to achieve a significant improvement in the protection against forgery of security documents, in particular of tickets and travel tickets, in vending machines.

Advantageous developments of the invention are described in the dependent claims.

According to a preferred embodiment example of the invention a cold adhesive layer or a UV-curable adhesive layer is used to apply the film element to the carrier substrate. By cold adhesive layer is meant here an adhesive layer in which the adhesive force between film element and carrier substrate imparted by the adhesive layer is activated solely by pressing the film element and carrier substrate together, i.e. is activated without the use of heat.

For example conventional adhesives that cure without the action of pressure and radiation or adhesives that cure under the action of pressure are used as cold adhesives.

Adhesives containing the following groups of substances are preferably used as UV-curable adhesives (quantities in weight-%):

| | |
|---|---|
| 50-80 | polyester acrylates |
| 2-20 | urethane acrylates |
| 10-15 | adhesion promoters |
| 3-8 | photoinitiator(s) |
| 3-10 | filler(s) |
| 0-5 | monomer acrylates |
| 0.1-2 | organic pigment(s) |

The adhesive layer is preferably cured using UV radiation with a wavelength of between approximately 250 nm and approximately 400 nm.

The adhesive layer is preferably formed transparent in the wavelength range which is visible to the human eye, in particular formed transparent and clear.

By "transparent" is meant a transmissivity in the wavelength range which is visible to the human eye of more than 50%, more preferably more than 80%, further preferably of 90%. By a "clear" adhesive layer is meant an adhesive layer in which, when light is transmitted through the adhesive layer, less than 50%, further preferably less than 80% of the transmitted light is scattered.

By preference, the adhesive layer preferably has a layer thickness of between 1 μm and 10 μm, preferably between 1 μm and 5 μm.

Here, the adhesive layer is preferably printed onto the carrier substrate to apply the film element, in particular printed by means of gravure, flexographic or offset printing. The adhesive layer is preferably not printed over the whole surface here but in a pattern. It is hereby possible, as is described in the following, through the patterned printing to control the shape of the film element applied to the carrier substrate without having to produce correspondingly expensive stamping or punching tools for this purpose.

The film element is preferably applied to the carrier substrate as part of a transfer layer of a transfer film. To apply the film element, in particular a transfer film comprising a carrier film and a transfer layer which can be removed from this is thus applied to the adhesive layer printed on the carrier substrate, the adhesive layer is activated by the pressure exerted here or by UV radiation and then the carrier film is peeled off. The area of the transfer layer which is in contact with the adhesive layer and thus adheres to the carrier substrate is here detached from the carrier film and remains as film element on the adhesive layer. Using a cold adhesive and/or a UV-curable adhesive for the adhesive layer furthermore also ensures here that the thermosensitive coating is not destroyed or activated as a result of applying the film element without sufficient action of heat to activate the thermosensitive coating and it thus remains writable.

The procedure described above furthermore makes it possible to vary the shape of the film element at low cost. The film element can, for example, be formed over the whole surface, in strips or in patches. If a patterned form of the film element not over the whole surface is used, the further advantage is achieved here that a further security feature can be provided here by molding the film element. It is thus possible, for example, using one and the same transfer film, to provide different series of security documents (for example annual, monthly, weekly and daily tickets) with a different security feature, which is provided by molding the film element, by molding the film elements applied to the carrier substrate in a correspondingly different way by a corresponding choice of the print pattern of the adhesive layer. The film element can for example have a finely structured edge and/or finely structured interruptions or fine grids, with the result that removal attempts result in the destruction of these fine structures. Attempts to cut it out are thereby made significantly more difficult. The fineness of the structures is only limited by the print resolution of the adhesive layer print which can be achieved, and can be below the resolution limit of the eye, in particular the smallest dimensions of the structures can be approximately 300 μm or below.

In top view, the film element thus preferably has a shape which is characterized by an edge which is structured at least in areas, in particular is finely structured, and/or is characterized in that the film element has a plurality of interruptions and/or the film element consists of a plurality of partial areas which are arranged separated from one another on the carrier substrate. The structure elements of the edge, the interruptions and/or the partial areas here preferably have a lateral dimension in at least one direction of less than 400 μm, in particular less than 300 μm, preferably between 300 μm and 50 μm.

In particular a finely gridded application of the adhesive layer and a correspondingly finely gridded film element can be advantageous in order for the film element to have the optical effect of an element applied to the whole surface, but the fine interruptions in the film element to achieve a better activation of the thermosensitive coating by the thermal print head even at higher printing speeds and/or lower printing temperatures. The fine grid can also be provided over only areas of the surface, with the result that one area of the surface of the film element is applied over the whole surface and another partial area is applied finely gridded.

According to a preferred embodiment example of the invention, after applying the film element a first item of information is inscribed in the security document by means of a thermal print head by activating the color change of the thermosensitive coating in areas, namely in such a way that at least part of the first item of information is covered by the film element when viewed perpendicularly to the plane spanned by the upper side of the carrier substrate. The first item of information is preferably an individualized item of information, for example the date of validity, the area of validity or the destination of the travel ticket desired by the customer. As a result of at least part of the first item of information being covered by the film element, as described above, subsequent tampering with the security document is made much more difficult.

Preferably the thermal print head is positioned on the side of the carrier substrate facing towards the film element during the inscription of the first item of information. The heat generated by the heating elements of the thermal print head thus transmits through the film element and activates a color change of the thermosensitive coating in the respective zones to form the first item of information.

The film element preferably has a layer thickness of between 3 μm and 25 μm, further preferably between 5 μm and 15 μm. The layers of the film element, which are located between heating elements of the thermal print head and the thermosensitive coating during the inscription of the first item of information, and the adhesive layer have a certain heat-insulating effect in relation to the heat coming from the heating elements of the thermal print head, which, however, due to the very small layer thickness of these layers, is almost negligible for the sufficient activation of the thermosensitive coating, as long as the inscription speed selected is not too high and the temperature selected for the heating elements is not too low. Starting from the known values for uncoated thermal paper, a person skilled in the art can, using a conventional thermal printer, set a somewhat higher temperature level for the thermal print head and/or a somewhat lower transport speed for the paper in order to achieve sufficiently good print results.

According to a preferred embodiment example of the invention at least one of the optical security features of the decorative layer of the film element has a security feature, recognizable in incident light, which is arranged in a transparent area of the film element.

A transparent area of the film element preferably has an (average) transmissivity in the wavelength range which is visible to the human eye in at least one spatial direction of more than 50%, further preferably of more than 70%. The transparent area of the film element is preferably formed such that optical items of information arranged beneath the film element are visible to a human observer in at least one spatial direction. These items of information are here preferably superimposed with the features of the security feature which are visible in incident light, with the result that the human observer perceives a combination of these items of information in this area.

A transparent area of the film element preferably covers the thermosensitive coating at least in areas, when viewed perpendicularly to the plane spanned by the upper side of the carrier substrate. Furthermore, the optically recognizable first item of information is preferably inscribed in the security document by activating the color change of the thermosensitive coating in areas in such a way that at least part of the first item of information is covered by a transparent area of the film element, when viewed perpendicularly to the plane spanned by the upper side of the carrier substrate.

Preferably furthermore at least one of the optical security features of the film element is arranged in such a way that it covers, at least in areas, the thermosensitive coating and in particular also the first item of information, when viewed perpendicularly to the plane spanned by the upper side of the carrier substrate.

This measure makes it possible to further increase the protection against forgery of the security document. It is hereby possible for the first item of information and one or more security features of the film element to be perceived by the observer as combined information or superimposed items of information or for the first item of information to have hereby an optically variable appearance. This makes tampering attempts even more difficult and also additionally makes it more difficult to forge the security document.

The decorative layer preferably has one or more layers providing the security feature. This layer or these layers preferably have one or more of the following elements: UV or IR print, microprint, layer containing optically variable pigments, layer containing a refractive element or diffractive element, an isotropic or anisotropic matt structure, a relief hologram, a volume hologram, a zero-order diffraction structure, a thin-film layer element generating a viewing-angle-dependent color shift effect and/or a crosslinked liquid crystal layer. By combining several of these elements the protection against forgery can be further increased. UV print is invisible in visible light and only visible in ultraviolet light, in particular in a specific UV wavelength range. IR print is invisible in visible light and only visible in infrared light, in particular in a specific IR wavelength range.

As optically variable pigments, thin-film layer pigments or liquid crystal pigments are preferably used here. A refractive element is formed for example from one or more lenses, a microlens grid, prisms or blazed gratings. A diffractive element is preferably formed from a relief structure with a spatial frequency of between 100 lines/mm and 5000 lines/mm. This relief structure is preferably overlaid with a dielectric HRI or LRI layer (HRI=High Refractive Index, LRI=Low Refractive Index) to improve the visibility of the relief structure. An anisotropic matt structure is formed from a matt structure which has a scatter effect which differs depending on the viewing angle. A zero-order diffraction structure is preferably formed from a relief structure with a spacing between the structure elements of less than one wavelength $\lambda$ in the range of visible light. This relief structure is preferably overlaid with a dielectric HRI or LRI layer (HRI=High Refractive Index, LRI=Low Refractive Index) to exploit the waveguide effect forming hereby. The thin-film layer elements which generate a color shift effect which is dependent on the viewing angle have one or more spacing layers, the refractive index of which differs from the refractive index of the adjacent layers or media and in which the thickness of the spacer layer has an optical thickness of $\lambda/2$ or $\lambda/4$ for $\lambda$ in the wavelength range of the light visible to the human eye. A crosslinked liquid crystal layer is preferably a nematic or cholesteric liquid crystal layer which codes an item of information which is recognizable by means of a polarizing filter or displays a color shift effect which is dependent on the viewing angle.

The film element preferably has a transparent replication layer and a transparent reflection-intensifying layer. In the boundary layer between the replication layer and the reflection-intensifying layer a relief structure is preferably molded here which provides an optical security feature. This relief structure here can, for example, be the relief structure of a 2D/3D hologram, a diffractive security element, such as a Kinegram®, or also a refractive structure, for example a microlens grid.

As transparent reflection-intensifying layer a (dielectric) layer is preferably used, the refractive index of which differs from the refractive index of the replication layer by at least 0.2. An HRI or LRI layer, for example a ZnS layer, is preferably used as transparent reflection-intensifying layer.

Furthermore, the transparent reflection-intensifying layer is preferably formed from a metal layer. The layer thickness of the metal layer or its molding is here selected such that the average transmissivity of this layer is more than 60%, preferably more than 80% in the wavelength range which is visible to the human eye. The layer thickness of the metal layer is thus selected to be correspondingly thin to fulfil these transmissivity conditions. Furthermore, it is also possible for the metal layer to be formed from a sequence of a plurality of first zones, in which the metal of the metal layer is provided, and second zones, in which the metal of the metal layer is not provided, wherein the dimension of the first and second zone is smaller than 300 μm, preferably less than 50 μm. Such a metal layer can be produced using vapor deposition methods, for example tin vaporization, or by corresponding demetallization of a metal layer applied over the whole surface.

Furthermore, it is also advantageous for the film element also to comprise opaque areas in addition to transparent areas and in particular for a further one or more security features which are recognizable in incident light to be provided in these opaque areas. Through the arrangement of opaque and transparent areas and the molding of these areas, an additional security feature is provided which is easily recognizable to the observer, and the protection against forgery is further increased.

Furthermore, it is also possible for the film element to be formed transparent over the whole surface.

According to a preferred embodiment example of the invention the carrier substrate comprises a thermal paper or consists of a thermal paper.

The carrier layer is preferably coated with the thermosensitive coating and the thermosensitive coating extends into the volume of the carrier layer at least in areas. The protection against forgery of the security document is hereby further increased as the first item of information thus also extends into the carrier layer during inscription and thus subsequent tampering is further made more difficult.

It has further proved worthwhile for the carrier layer to be a paper, in particular having a thickness of between 20 μm and 500 μm, in particular between 50 μm and 200 μm, or for the carrier layer to have one or more paper and/or plastic layers.

According to a preferred embodiment example of the invention the carrier substrate has one or more layers providing a second item of optical information. These layers are preferably formed from a security imprint, a colored lacquer layer, a layer containing optically variable pigments, UV or IR active pigments or dyes.

These layers are preferably applied by means of gravure, offset or intaglio printing.

The thermosensitive coating is preferably applied with an application weight of between 1 and 60 g/m$^2$ after drying.

The thermosensitive coating preferably has a dye which undergoes a color reaction under the action of goods. This color reaction leads in particular to a color change which is recognizable to the human observer, for example from colorless into a color such as black or red or from a first color, for example white, into a second color, for example red.

The dyes are preferably colorless in the unactivated state. Furthermore, the coating preferably has co-reactants which react in a color reaction in a melt with the dye when heat is applied.

The thermosensitive coating is preferably transparent and in particular colorless before the action of heat. Following the action of heat, a color change takes place preferably into an opaque surface color, in particular into a dark surface color such as black. The degree of opacity of the activated areas of the thermosensitive coating is preferably more than 50%, preferably more than 70%.

The activation temperature at which the thermosensitive coating is caused to change color is preferably above 50° C., in particular above 60° C.

The production of the security document preferably takes place in a roll-to-roll process. Preferably the step of applying the film element to the carrier substrate is further carried out several times spaced apart from one another laterally and thus, as security document, a security paper is obtained which can be separated into several individual security documents. This security paper is in particular separated into individual security documents after the inscription of the first item of information, for example in vending machines.

The security document is preferably used as a security paper, as a ticket, as a travel ticket, as a concert ticket, as a boarding pass, as a tag or label for product security, as a software certificate etc.

BRIEF DESCRIPTION OF THE DRAWINGS

The invention is explained by way of example below with reference to several embodiment examples with the aid of the attached drawings.

DETAILED DESCRIPTION OF THE INVENTION

Figure 1:
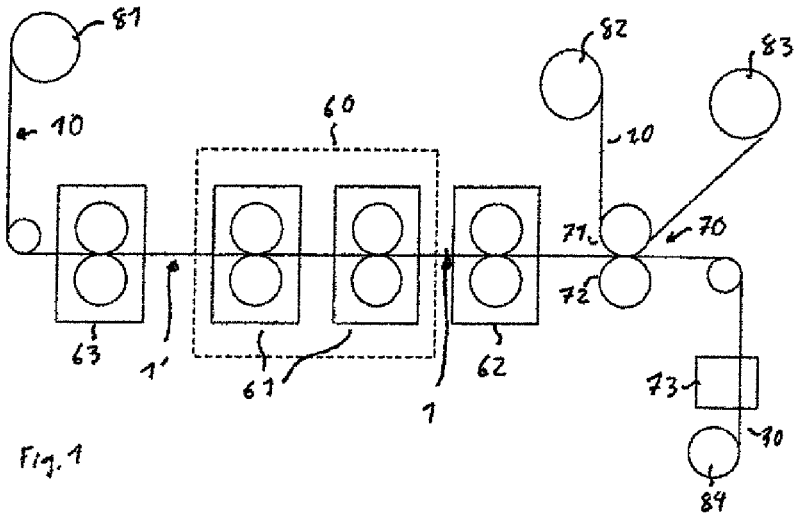
FIG. 1 shows a schematic functional representation to illustrate a method for producing a security document.
Figure 2:
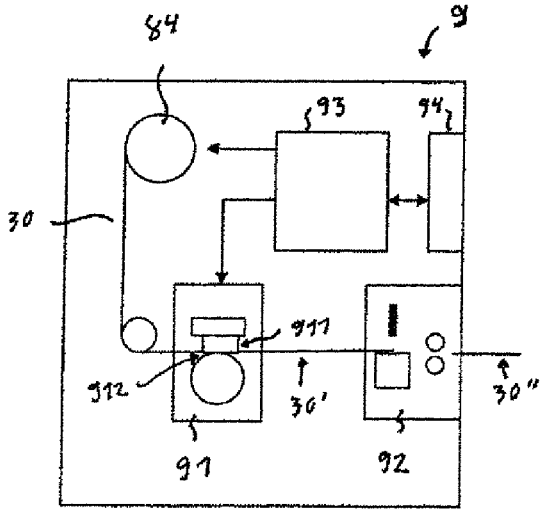
FIG. 2 shows a schematic functional representation to illustrate a method for producing an individualized security document.

FIG. 1 and FIG. 2 illustrate the basic sequence of a method for producing a security document, in particular a ticket or a travel ticket. FIG. 1 illustrates here the production of security documents in an advantageous large-scale roll-to-roll process and FIG. 2 illustrates the individualization of the security documents produced in this way at the point of sale, for example in a travel ticket vending machine.

FIG. 1 shows several film rolls 81, 82, 83 and 84, several printing mechanisms 63, 61 and 62. An application unit 70 and a separator 73.

The printing mechanisms 61 to 63 are preferably gravure or offset printing devices.

A film web, which forms a carrier layer 10, is wound onto the film roll 81. This film web is fed to the printing mechanism 63, which prints onto the carrier layer 10 a thermosensitive coating which can be caused to change color by the action of heat, in particular by means of a thermal print head. The thermosensitive coating here can be applied by the printing mechanism 63 to the carrier layer 10 over the whole surface or also in a pattern.

The multilayer body 1' formed in this way comprising the carrier layer 10 and the applied thermosensitive coating is now fed to a printing unit 60 which can comprise one or more printing mechanisms 61. The printing mechanism 63 can also be arranged in a separate machine, with the result that the multilayer body 1' is wound up and unwound again between the printing mechanisms 63 and the printing unit 60. By means of the printing mechanisms 61, one or more further layers are now printed onto the upper side and/or the underside of the multilayer body 1'. These layers can, for example, be layers showing items of optical information, protective layers, and/or adhesion-promoting layers. A single- or multicolored security print is preferably applied here by the printing unit 60 to the upper side and/or underside of the multilayer body 1'.

The carrier substrate 1 formed in this way is now fed to the printing mechanism 62. The printing mechanism 62 prints an adhesive layer onto the side of the carrier substrate 1 on which the thermosensitive coating is also applied to the carrier layer 10. The adhesive layer here can be printed on the carrier substrate 1 over the whole surface or in a pattern, as is also explained in more detail in the following. The printed adhesive layer here preferably consists of a cold adhesive or a UV-curable adhesive.

The film web formed in this way is then fed to the applicator 70. A film web, which forms a transfer film 20, is wound onto the film roll 82. This is likewise fed to the application unit 70. The application unit 70 preferably has an applying roller 71 and a counterpressure roller 72 which press the carrier substrate with the film web comprising the adhesive layer as well as the transfer film 20 against each other. The adhesive layer is activated by the pressure exerted here and/or optionally by an additionally acting UV-radiation, and the area of the transfer layer of the transfer film 20 which is in contact with the adhesive layer is bonded to the carrier substrate 1 via the adhesive layer. In the following, the transfer film 20 is peeled off the carrier substrate 1 by separating the webs, wherein the area of the transfer layer which is in contact with the adhesive layer detaches from the transfer film 20 and remains on the adhesive layer as film element. The rest of the transfer film 20 which remains is wound onto the film rolls 83. The film web formed in this way is then fed to the separator 73 which cuts the film web into individual, in particular strip-shaped, areas of a predetermined length. The security document 30 formed in this way, which here consists of a security paper which can be separated into a plurality of individual security documents, is then wound onto the film roll 84.

It is not necessary for the method steps described above to be carried out in an in particular continuous roll-to-roll process. Furthermore, it is advantageous to dispense with the printing mechanism 63 and to use a ready-made substrate provided with a thermosensitive coating as starting product. The use of thermal paper, for example Mitsubishi Thermoscript TF 12 or Mitsubishi Thermoscript IF 7067 paper, has proved worthwhile in particular here as substrate provided with a thermosensitive coating.

Furthermore, it is also possible to dispense with the printing unit 60 and, for example, to feed the thermal paper wound onto a film roll directly to the printing mechanism 62. Furthermore, it is also possible, for example, to print on the thermal paper in a separate production unit by means of the printing unit 60 and then to transport the film roll produced in this way to the printing mechanism 62 and to feed it to the printing mechanism 62 as starting substrate.

Furthermore, the separator 73 can also be dispensed with.

A sheet-fed printing machine can also be used for printing with the adhesive. The transfer film can further also be applied by means of corresponding stampers. Furthermore, it is also possible not to apply the film element as part of a transfer layer of a transfer film but for example to apply a correspondingly pre-cut laminating film or a correspondingly ready-made film element by corresponding counterpressure. In this case it is also advantageous to apply the adhesive layer to the film element to be applied and not to apply it to the carrier substrate.

The structure of the transfer film 20 is explained in the following with reference to FIG. 3 and FIG. 5.

The transfer film 20 has a carrier film 21 and a transfer layer 27 which can be separated or detached from this.

The carrier film 21 preferably consists of a plastic film having a thickness of between 6 μm and 125 μm, for example a PET film (PET=polyethylene terephthalate) having a thickness of 12 μm. A removal layer 22, which preferably consists of a layer containing wax components which makes it easier to remove the transfer layer 27 from the carrier film 21, is applied to the carrier film 21. The transfer layer 27 preferably has a sequence of a protective lacquer layer 23, one or more decorative layers 24, 25 and an adhesion-promoting layer 26. The protective lacquer layer 23 preferably has a layer thickness of approximately 1 μm. The adhesion-promoting layer 26 preferably has a layer thickness of less than 1 μm. The protective lacquer layer 23 and the adhesion-promoting layer 26 as well as further also the removal layer 22 could also be dispensed with.

The decorative layer has at least one optical security feature.

The decorative layer can here likewise consist of one or more layers which are necessary to generate the corresponding security features.

For example, the decorative layer can have a layer containing a security print, a UV or IR print, a microprint or an imprint or a layer containing optically variable pigments. Such layers are generated for example by imprinting corresponding printing materials by means of suitable printing methods, wherein printing methods such as gravure, intaglio or pad printing can also be used. From layers of this type, security features are thus provided which are characterized by a security print, a microprint recognizable by means of a microscope, a UV or IR print which is recognizable by means of UV or IR illumination or a viewing-angle-dependent color shift effect which is generated by the optically variable pigments.

Furthermore, it is also advantageous for the decorative layer to have layers which provide a refractive element, a diffractive element, an anisotropic matt structure, a relief hologram or a zero-order diffraction structure, which provide one or more optically recognizable, in particular optically variable security features. The decorative layer preferably comprises here a replication layer and a reflection-intensifying layer, wherein one or more relief structures are molded in a surface of the replication layer, in particular in the boundary layer between replication layer and reflection-intensifying layer.

Figure 3:
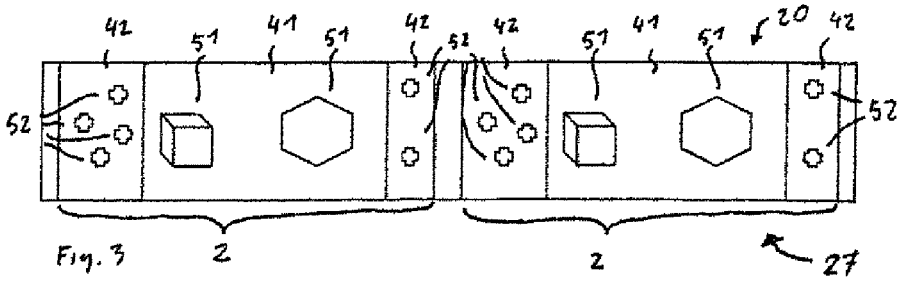
FIG. 3 shows a schematic top view of a transfer layer of a transfer film.
Figure 5:
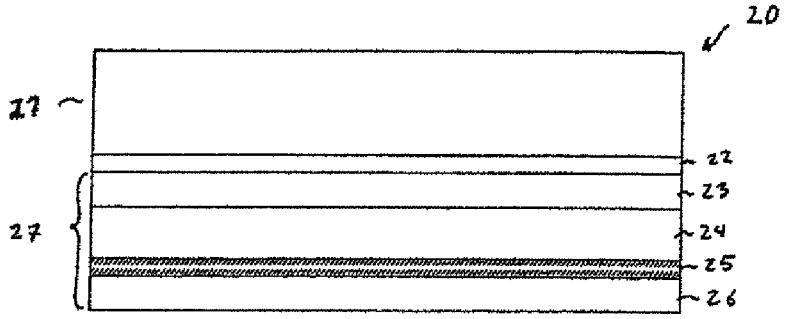
FIG. 5 shows a schematic sectional representation of the transfer film according to FIG. 3.

The embodiment example according to FIG. 3 and FIG. 5 illustrates a transfer layer 27 with a decorative layer of this type, which has a replication layer 24 and a reflection-intensifying layer 25 which is preferably adjacent to the latter.

The replication layer 24 preferably consists of a thermoplastic or UV-curable replication lacquer layer having a layer thickness of between 1 and 3 μm. The relief structure is molded in the surface of the replication layer 24 oriented towards the reflection-intensifying layer 25 by means of a corresponding replicating tool using heat and pressure when a thermoplastic replication layer is used, or by subsequent or simultaneous UV-irradiation in the case of a UV-curable replication layer.

As already explained above, the relief structures can be the relief structure of a 2D/3D hologram which is generated holographically and copied onto the replication master. The relief structures can furthermore also be computer-generated holograms and diffractive elements, for example a Kinegram®. Relief structures of this type preferably have a spatial frequency of between 100 lines/mm and 5000 lines/mm and optionally have a plurality of different areas which are overlaid with relief structures which differ in their spatial frequency, their azimuth angle and/or the shape of their relief and thus generate a desired optically variable appearance. Furthermore, the relief structures can also be relief structures which form matt structures, in particular anisotropic matt structures. By anisotropic matt structures is meant here matt structures, the scatter characteristic of which is dependent on the viewing angle and thus displays an optically variable appearance. These matt structures are preferably generated holographically, but can also be formed by a corresponding computer-generated arrangements of diffractive elements.

Furthermore, it is possible for the relief structures to form refractive elements, for example lenses, microlens grids or microprisms. Furthermore, it is also possible for the relief structures to form a zero-order diffraction structure. These diffraction structures are formed from gratings, in particular regular gratings, for example cross gratings or linear gratings, in which the spacing of the individual structure elements from one another is smaller than a wavelength λ in the range of visible light. Such relief structures provide a distinctive optically variable security feature in which a color change is displayed to the observer when rotated.

The reflection-intensifying layer 25 can be formed over the whole surface or partially. Furthermore, it is also possible for the reflection-intensifying layer 25 to be formed in areas as an opaque reflection-intensifying layer and in areas as a transparent reflection-intensifying layer.

As transparent reflection-intensifying layer a (transparent) layer is preferably used, the refractive index of which differs from the refractive index of the replication layer 24 by at least 0.2. An HRI or LRI layer, for example ZnS, is preferably used as transparent reflection-intensifying layer. Furthermore, it is however also possible to use as transparent reflection-intensifying layer a metal layer which is selected to be correspondingly thin, such that the layer still has at least a certain residual transmissivity for the human eye, or which is correspondingly finely structured, with the result that sufficient light is still transmitted through this layer and in particular items of information arranged beneath this layer are still visible to the human observer.

Opaque reflection-intensifying layers are preferably formed from a metal layer or from a transparent reflection-intensifying layer provided with a corresponding opaque lacquer layer.

Aluminum, silver, gold and copper are preferably used as metal for the reflection-intensifying layer 25. Here it is also possible for different areas of the reflection-intensifying layer 25 to be formed from different metals which, as a result of their inherent color, also bring about a corresponding different optical appearance of the corresponding optical security features.

Furthermore, it is also possible to use as decorative layer a volume hologram layer in which a volume hologram is inscribed.

Furthermore, it is also possible for the decorative layer to have one or more thin-film layer elements which generate a color shift effect which is dependent on the viewing angle. Such a thin-film layer element has one or more spacer layers which are adjacent to a medium having a different refractive index and the optical thickness of which is in each case in the region of λ/2 or λ/4 for a wavelength λ in the range of visible light. A thin-film layer element of this type can thus consist for example of a sequence of an absorption layer, for example a thin metal layer, a dielectric spacer layer and a reflection-intensifying layer, or also of an even-numbered or odd-numbered sequence of high and low refractive index layers which act as spacer layers.

Furthermore, it is also possible for the decorative layer to have a crosslinked liquid crystal layer. Liquid crystal layers of this type on the one hand display security features which are recognizable by means of a polarizing filter. If a cholesteric liquid crystal material is used, it is further possible, through such liquid crystal layers, to provide a security feature which displays a color shift effect which is dependent on the viewing angle.

FIG. 3 shows a top view of a section of the transfer layer 27 of the transfer film 20. As indicated in FIG. 3, this section is provided to provide two film elements 2 for application to security documents. Here, the portions providing the respective film element 2 are structured identically. The film elements 2 thus each have an area 41 in which the film element is formed transparent and an area 42 in which the film element 2 is formed non-transparent. In the transparent area 41 one or more security features 51 are provided and in the non-transparent area 42 one or more security features 52 are provided. The security features 51 and 52 are provided by the corresponding design of the decorative layer as described above. The security features 51 thus represent security features which are recognizable in incident light and which are arranged in a transparent area of the film element 2, and the security features 52 represent security features which are recognizable in incident light and which are arranged in an opaque area of the film element 2. An optically recognizable security feature can further be implemented in the film element 2 by a special, patterned molding of the transparent areas 41 and the non-transparent areas 42. For example, the security features 51 and 52 can each be formed by diffractive relief structures and/or matt structures which are overlaid in the non-transparent area 42 with an opaque metallic reflection layer, in particular of vapor-deposited aluminum, and are overlaid in the transparent area 41 with a transparent vapor-deposited HRI reflection layer.

Figure 6A:
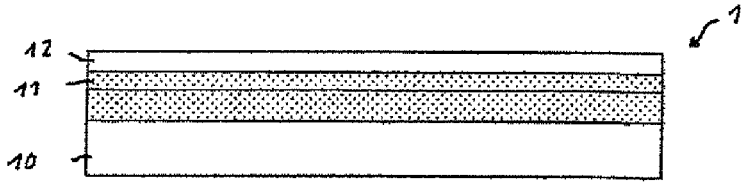
FIG. 6*a* shows a schematic sectional representation of a carrier substrate.

FIG. 6*a* shows a sectional representation of the carrier substrate 1 fed to the printing mechanism 62. The carrier substrate 1 has the carrier layer 10 and the thermosensitive coating 11 mentioned above as well as a layer 12 applied by the printing unit 60. As shown in FIG. 6*a*, the thermosensitive coating applied to the carrier layer 10 extends at least in areas into the volume of the carrier layer 10.

The carrier layer 10 is preferably a paper layer, preferably with a layer thickness of between 70 μm and 250 μm, for example 125 μm. The carrier layer further preferably has a weight per unit area of 40 to 300 g/m$^2$ (oven-dry). Furthermore, it is also possible for the carrier layer to consist of one or more paper and/or plastic layers and in particular of a sequence of paper and plastic layers.

The thermosensitive coating 10 can consist of one or more layers. The thermosensitive coating can for example comprise a first coating which has thermal energy insulating properties (insulation layer), a thermoreactive layer applied to this and a protective layer applied to this.

The insulation layer preferably contains pigments selected from the group kaolin, calcined kaolin, calcium carbonate, zinc oxide, aluminum oxide, titanium dioxide, silicon dioxide, aluminum hydroxide, barium sulfate, zinc sulfate, talc, clay, colloidal silicon dioxide, hollow sphere pigments or mixtures thereof.

The thermosensitive coating preferably comprises a thermal reactive layer which contains, for example, leuco dyes which are colorless in the unactivated state, as well as co-reactants which react with one another in a melt when heat is applied. In the case of leuco dyes, a lactone ring is opened thermally and a color reaction occurs. The thermal reactive layer preferably contains a color raw material and/or a color development material. Examples of such color raw materials are triarylmethane-based color raw materials, diphenylmethane-based color raw materials, spiro-based color raw materials and fluoran-based color raw materials. The color development material can be selected from organic or inorganic materials which trigger the color reaction in contact with the color raw materials. The color development material is preferably acidic. Examples of inorganic color development materials are activated clay, attapulgite, colloidal silica, aluminum silicate and the like. Examples of organic color development materials are phenolic compounds, salts of phenolic compounds or aromatic carboxylic acids and the like with polyvalent metals such as e.g. zinc, magnesium, aluminum, calcium, titanium, manganese, tin, nickel and the like and/or pyrin complexes of zinc thiocyanates.

The thermosensitive coating or the individual layers of which the thermosensitive coating consists each have preferably an application weight of 1 to 20 g/mm (oven-dry) after drying.

The layer 12 preferably forms a layer providing an optical item of information. This layer consists in particular of a security print, a colored lacquer layer, a layer containing optically variable pigments, UV or IR active pigments or dyes. This layer thus preferably provides standardized basic information for all value documents, for example all tickets.

Figure 6B:
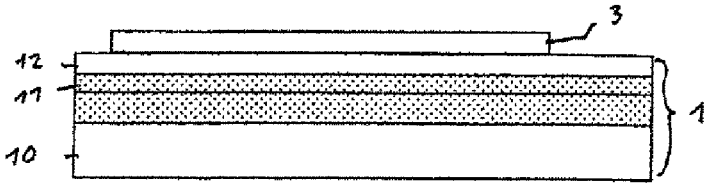
FIG. 6*b* shows a schematic sectional representation of a carrier substrate with an adhesive layer applied to it.

The adhesive layer 3 is then applied to the carrier substrate 1 formed in this way, as shown in FIG. 6*b*. The adhesive layer 3 here is preferably applied patterned in a shape which is to correspond to the shape of the film element 2 on the carrier substrate.

Figure 6C:
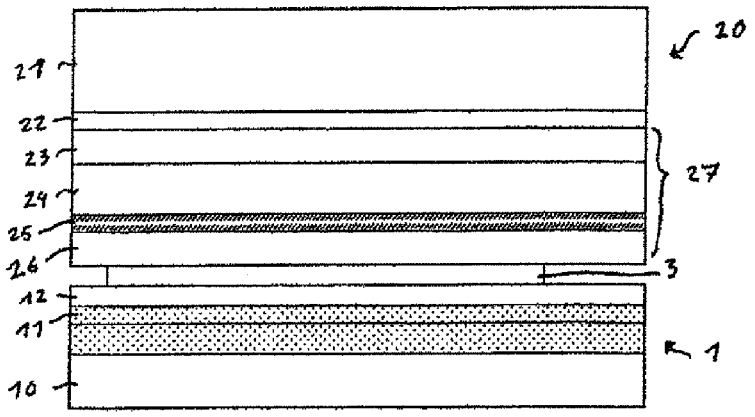
FIG. 6*c* shows a schematic sectional representation of a multilayer body after the application of the transfer film according to FIG. 3 onto the carrier substrate provided with an adhesive layer according to FIG. 6*b*.
Figure 6D:
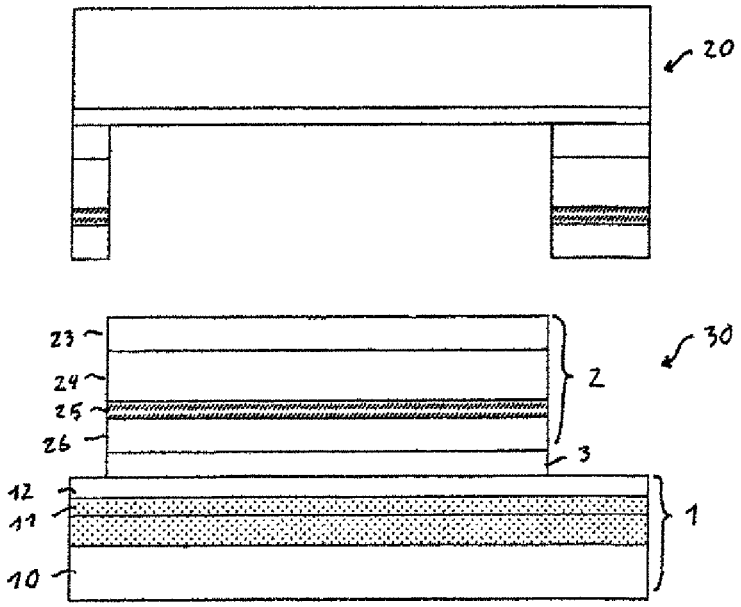
FIG. 6*d* shows a schematic sectional representation of a security document after the carrier film has been peeled off, starting from the multilayer body according to FIG. 6*c*.

As shown in FIG. 6*c*, the transfer film 20 is then brought together with the carrier substrate 1, with the result that the adhesive layer 3 is arranged between transfer film 20 and the carrier substrate 1. By contacting the adhesive layer 3, the transfer film 20 adheres to the carrier substrate 1 in these areas, with the result that, after the transfer film 20 has been peeled off the carrier substrate 1, the area of the transfer layer 27 which is in contact with the adhesive layer 3 is removed from the transfer film 20 and remains on the carrier substrate 1 as film element 2. The security document 30 resulting in this way is shown by way of example in top view in FIG. 4*a*.

Figure 4A:
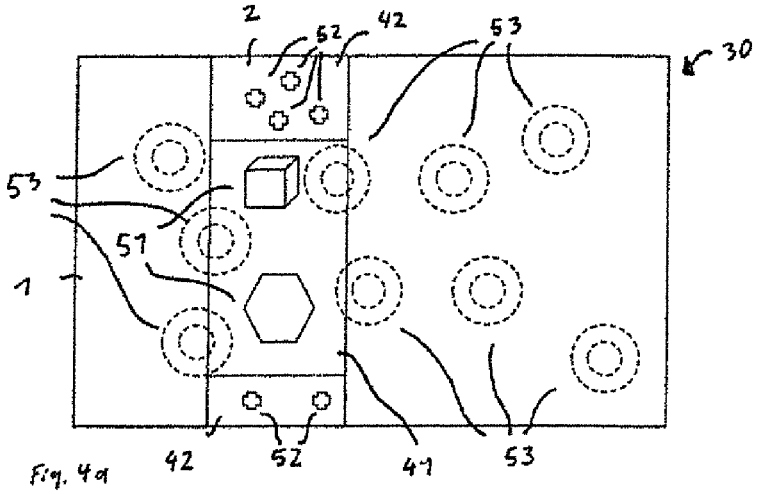
FIG. 4*a* shows a schematic top view of a security document.

FIG. 4*a* shows the security document 30 with the carrier substrate 1 and the film element 2. The layer 12 of the carrier substrate 1 provides several items of optical information 53, which are indicated by way of example in FIG. 4*a* by dashed lines.

In the embodiment example according to FIG. 4*a*, the film element 2 has a strip shape and extends over the entire width of the security document 30. However, it is also possible for the film element 2 to have any other desired shape, for example covering the whole surface of the security document 30 or for example molded in the form of a patch. The shape of the film element 2 is, as already described above, determined by the molding of the adhesive layer 3, with the result that the film element 2 can have any desired shape. Thus it is for example advantageous for the edges in the case of a strip-shaped form of the film element 2 not to be formed straight, as indicated in FIG. 4*a*, but for example to be saw-toothed or in the form of a pattern and thus to form an additional security feature.

As already stated above, the film element 2 has one or more transparent areas 41 in which the areas of the carrier substrate 1 lying beneath are recognizable to the human observer in at least one spatial direction. As indicated in FIG. 4*a*, the items of information 53 applied to the carrier substrate 1 are thus visible through the film element 2 in the areas 41. Further, one or more security features 51 are generated in the area 41 by the film element 2 through the decorative layer or the decorative layers of the film element 2, with the result that one or more of the optical security features of the decorative layer are arranged in one of the transparent areas 41.

The security features 51 are preferably security features which only reflect part of the incident light to generate an optical security feature by diffraction/reflection and transmit part of the light, with the result that the items of information 53 lying beneath are recognizable through these security features 51 and are superimposed with these optically. Such security features are generated for example by the layer structure described above with a replication layer and a transparent reflection-intensifying layer.

Furthermore, the film element 2 preferably has one or more additional opaque areas 42 in which the items of information of the carrier substrate lying beneath are not recognizable, or are only recognizable with difficulty, to the human observer. The security features 52 are further provided in these opaque areas 42. In the embodiment example above, these are formed for example by a replication layer with molded relief structures and an opaque reflection-intensifying layer.

FIG. 2 shows the schematic structure of a device 9 for issuing an individualized security document. The device 9 represents for example a travel ticket vending machine.

Figure 7A:
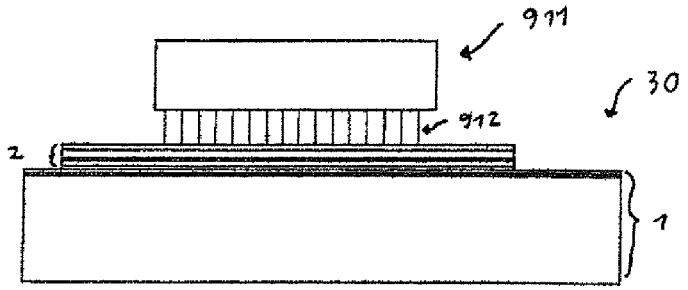
FIG. 7*a* shows a schematic sectional representation of a security document and a thermal print head inscribing the security document.
Figure 7B:
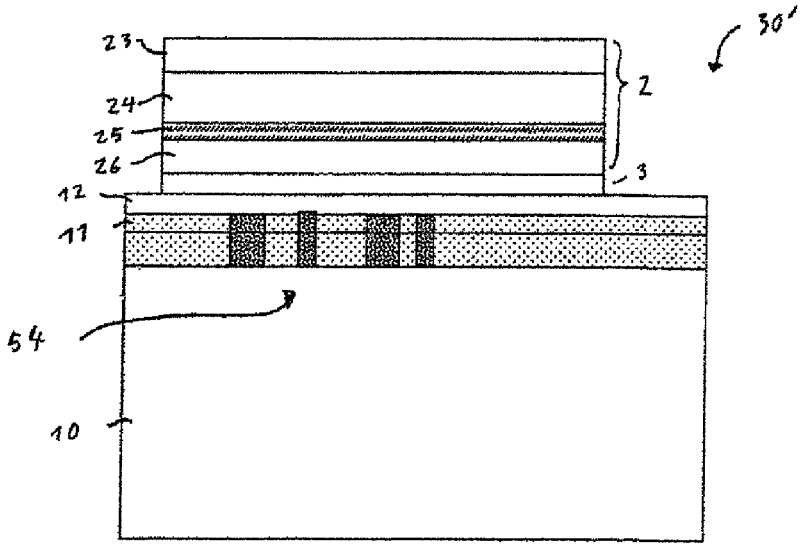
FIG. 7*b* shows a schematic sectional representation of an individualized security document.

The device 9 has an input device 94, a control device 93, a printer 91 and an issuing device 92. A film roll 84 produced according to FIG. 1 is fed to the device 9. The security document formed as security paper 30 is unwound from the film roll 84 and fed to the printer 91. The printer 91 has at least one thermal print head 911 which is controlled by the control device 93. The thermal print head 911 here is brought into contact with the upper side of the security document 30, as is indicated in FIG. 7*a*. Heating elements 912 of the thermal print head 911 are thus brought into contact with the side of the security paper 30 on which the film element 2 is applied to the carrier substrate 1. As indicated in FIG. 7*b*, the heat generated by the heating elements 912 is transmitted through the film element 2, with the result that the thermosensitive coating 11 is activated in areas and a color change is activated. By corresponding control of the thermal print head 911 by the control device 93 an individualized item of information 54 is thus inscribed by activating the color change of the thermosensitive coating in areas.

It has proved to be particularly advantageous here to use one of the following printers as printer 91: CAB a4+ (cab Produkttechnik GmbH & Co. KG, Karlsruhe), Avery Dennison 64-08 (Avery Dennison, USA), Zebra 110Xi4 (Zebra Technologies Corporation USA).

These printers are preferably operated with the following parameters:

If Mitsubishi thermoscript TF 7067 is used as carrier substrate, CAB a4+ at temperature level 2, 4, 6, 8, speed 75, 100, 150, 200 mm/s;

Avery Dennison 64-08 at temperature level 25, 50, 75, 100, speed 76.2, 101.6, 152.4 mm/s;

Zebra 110Xi4 at temperature level 10, 15, 20, 25, speed 76.2, 101.6, 152.4 mm/s.

If Mitsubishi thermoscript TF 1267 is used as carrier substrate,

CAB a4+ at temperature level 2, 4, 6, 8, speed 75, 100, 150, 200 mm/s;

Avery Dennison 64-08 at temperature level 25, 50, 75, 100, speed 76.2, 101.6, 152.4 mm/s;

Zebra 110Xi4 at temperature level 10, 15, 20, 25, speed 76.2, 101.6, 152.4 mm/s.

The security document 30' individualized in this way is optionally detached from the film web and separated in the issuing device 92 and then issued as an individualized security document 30".

Figure 4B:
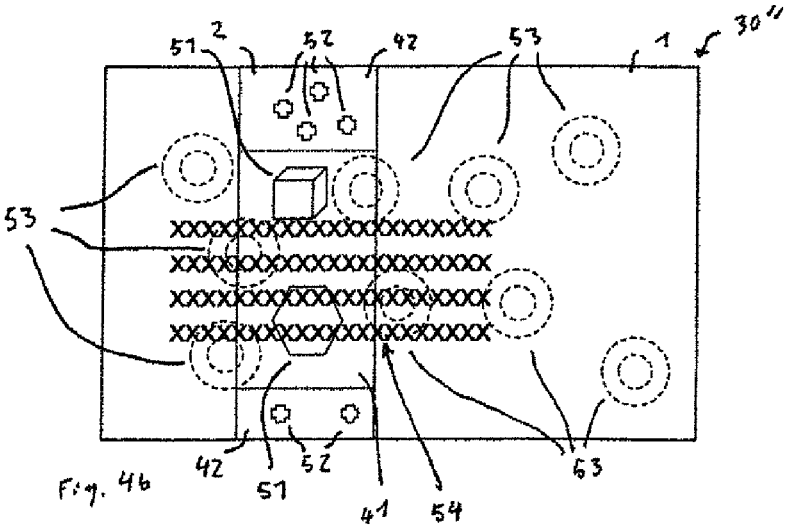
FIG. 4*b* shows a schematic top view of an individualized security document.

The security document 30" is shown in FIG. 4*b* by way of example.

The security document 30" is structured like the security document 30 according to FIG. 4*a* except that in addition an item of information 54 is inscribed in the security document by activating the color change of the thermosensitive coating 11 in areas. The security document 30 thus has the carrier substrate 1 with the item of information 53 as well as the film element 2 with the transparent areas 41, the opaque areas 42 and the security features 51 and 52. As shown in FIG. 4*b*, the item of information 54 is inscribed in the security document in such a way that at least part of the item of information 54 is covered by a transparent area 41 of the film element 2. Thus at least part of the item of information 54 is visible through the film element 2. Furthermore, at least one of the optical security features 51 of the film element 2, which is arranged in the transparent area 41 of the film element 2, covers the item of information 54 at least in areas. The item of information 54 is hereby visible through the security feature 51 and the item of information 54 and the security feature 51 superimpose each other optically, whereby security is increased significantly still further.

The invention claimed is:

1. A security document comprising a carrier substrate, a film element and an adhesive layer arranged between the carrier substrate and the film element, wherein the carrier substrate has a carrier layer, and wherein the film element is transparent at least in areas and has at least one decorative layer with at least one optical security feature, and wherein the carrier substrate comprises a thermal paper and/or wherein the carrier layer is coated with a thermosensitive coating and the thermosensitive coating extends at least in areas into the volume of the carrier layer, and wherein the thermal paper and/or the thermosensitive coating is arranged between the adhesive layer and the carrier layer, and wherein the film element covers the thermal paper and/or the thermosensitive coating at least in areas when viewed perpendicularly to the plane spanned by the upper side of the carrier substrate, and wherein the thermal paper and/or the thermosensitive coating can be caused to change color by the action of heat by means of a thermal print head.

2. A security document according to claim 1, wherein the adhesive layer comprises a cold adhesive and/or a UV-curable adhesive.

3. A security document according to claim 1, wherein the adhesive layer is transparent in the wavelength range which is visible to the human eye.

4. A security document according to claim 1, wherein the adhesive layer has a layer thickness of between 1 μm and 5 μm.

5. A security document according to claim 1, wherein the film element has a layer thickness of between 5 μm and 15 μm.

6. A security document according to claim 1, wherein at least one of the optical security features of the decorative layer is a security feature which is recognizable in incident light and which is arranged in a transparent area of the film element.

7. A security document according to claim 1, wherein an optically recognizable first item of information is inscribed in the security document by activating the color change of the thermosensitive coating in areas in such a way that at least part of the first item of information is covered by a transparent first area of the film element when viewed perpendicularly to the plane spanned by the upper side of the carrier substrate.

8. A security document according to claim 7, wherein at least one of the optical security features of the film element is located in the first area and covers the first item of information at least in areas when viewed perpendicularly to the plane spanned by the upper side of the carrier substrate.

9. A security document according to claim 1 comprising a plurality of decorative layers which provide the security feature and which contain one or more elements selected from the group: a security print, a UV or IR print, a microprint, a layer containing optically variable pigments, a refractive element, a diffractive element, an anisotropic matt structure, a relief hologram, a volume hologram, a zero-order diffraction structure, a thin-film layer element generating a viewing-angle-dependent color shift effect and/or a crosslinked liquid crystal layer.

10. A security document according to claim 1, wherein the film element has a transparent replication layer and a transparent reflection-intensifying layer and wherein one or more relief structures which provide an optical security feature are molded in a surface of the replication layer.

11. A security document according to claim 10, wherein the transparent reflection-intensifying layer is formed from a layer, the refractive index of which differs from the refractive index of the replication layer by at least 0.2, the layer being an HRI or LRI layer.

12. A security document according to claim 10, wherein the transparent reflection-intensifying layer is formed from a metal layer the layer thickness and/or molding of which is selected such that it has an average transmissivity in the wavelength range which is visible to the human eye of more than 60%.

13. A security document according to claim 1, wherein at least one of the optical security features of the decorative layer is a security feature which is recognizable in incident light and which is arranged in an opaque area of the film element.

14. A security document according to claim 1, wherein the carrier layer is a paper layer, having a thickness of between 50 μm and 250 μm.

15. A security document according to claim 1, wherein the carrier substrate has one or more layers which provide a second optical item of information and has a security print, a colored lacquer layer, a layer containing optically variable pigments, UV or IR active pigments or dyes.

16. A security document according to claim 1, wherein the thermosensitive coating has an application weight after drying of between 1 and 60 g/m.

17. A security document according to claim 1, wherein the thermosensitive coating is transparent and colorless before the action of heat and after the action of heat displays a color change into an opaque dark surface color.

18. A security document according to claim 1, wherein the activation temperature at which the thermosensitive coating is caused to change color is above 60° C.

19. A method for producing a security document comprising the steps:

providing a carrier substrate with a carrier layer, wherein the carrier substrate comprises a thermal paper and/or wherein the carrier layer is coated with a thermosensitive coating and the thermosensitive coating extends at least in areas into the volume of the carrier layer, and wherein the thermal paper and/or the thermosensitive coating can be caused to change color by the action of heat;

applying a film element, which is transparent at least in areas and which has at least one decorative layer with at least one optical security feature, to the carrier substrate in such a way that the thermal paper and/or the thermosensitive coating is arranged between the film element and the carrier layer and the film element covers the thermal paper and/or the thermosensitive coating at least in areas when viewed perpendicularly to the plane spanned by the upper side of the carrier substrate, wherein after applying the film element a first item of information is inscribed in the security document by means of a thermal print head by activating the color change of the thermal paper and/or the thermosensitive coating in areas in such a way that at least part of the first item of information is covered by the film element when viewed perpendicularly to the plane spanned by the upper side of the carrier substrate.

20. A method according to claim 19, wherein to apply the film element to the carrier substrate, a cold adhesive layer or a UV-curable adhesive layer, is printed on in a pattern.

21. A method according to claim 20, wherein to apply the film element a transfer film comprising a carrier film and a transfer layer which can be removed from the latter is applied to the adhesive layer and the carrier film is peeled off, with the result that the transfer layer is removed from the carrier film in the area which is in contact with the adhesive layer and remains on the adhesive layer as film element.

22. A method according to claim 19, wherein the thermal print head is positioned on the side of the carrier substrate facing towards the film element during the inscription of the first item of information.

23. A method according to claim 19, wherein the step of applying the film element to the carrier substrate is carried out several times spaced apart from one another laterally and wherein the carrier substrate provided thus with film elements spaced apart from one another laterally is separated into individual security documents also after the first item of information has been inscribed.

24. A method for producing an individualized security document comprising the steps:

feeding in a security paper comprising a carrier substrate, which has a carrier layer, wherein the carrier substrate comprises a thermal paper and/or the carrier layer is coated with a thermosensitive coating and the thermosensitive coating extends at least in areas into the volume of the carrier layer and, wherein the thermal paper and/or the thermosensitive coating can be caused to change color by the action of heat, and wherein the security paper further comprises a film element which is transparent at least in areas, wherein the film element covers the thermal paper and/or the thermosensitive coating at least in areas when viewed perpendicularly to the plane spanned by the upper side of the carrier substrate;

inscribing a first item of information by means of a thermal print head by activating the color change of the thermal paper and/or the thermosensitive coating in areas in such a way that at least part of the first item of information is covered by the film element when viewed perpendicularly to the plane spanned by the upper side of the carrier substrate.

* * * * *